US005860406A

United States Patent [19]

Schmidt et al.

[11] Patent Number: 5,860,406

[45] Date of Patent: Jan. 19, 1999

[54] ENGINE TIMING APPARATUS AND METHOD OF OPERATING SAME

[75] Inventors: Lawrence E. Schmidt, Chillicothe; Wendell D. Stahl, Bradford; Paul M. Young, Peoria, all of Ill.

[73] Assignee: Caterpillar Inc., Peoria, Ill.

[21] Appl. No.: 630,806

[22] Filed: Apr. 10, 1996

[51] Int. Cl.[6] ..... F02M 37/04

[52] U.S. Cl. ..... 123/501; 123/479

[58] Field of Search ..... 123/500, 501, 123/479, 359

[56] References Cited

U.S. PATENT DOCUMENTS

| | | | |
|---|---|---|---|
| 4,131,014 | 12/1978 | Scott | 73/119 |
| 4,141,242 | 2/1979 | Scott | 73/117.3 |
| 4,158,305 | 6/1979 | Shipley | 73/119 |
| 4,369,651 | 1/1983 | Szentes | 73/119 |
| 4,370,962 | 2/1983 | Hosaka | 123/479 |
| 4,417,469 | 11/1983 | Stevenson et al. | 73/119 |
| 4,797,828 | 1/1989 | Suzuki | 123/479 |
| 4,825,691 | 5/1989 | Sekiguchi | 123/479 |
| 4,941,445 | 7/1990 | Deutsch | 123/479 |
| 4,972,332 | 11/1990 | Leubbering et al. | 364/565 |
| 5,000,042 | 3/1991 | Leubbering | 73/119 |
| 5,182,943 | 2/1993 | Fukui et al. | 73/116 |
| 5,201,296 | 4/1993 | Wunning | 123/479 |
| 5,209,202 | 5/1993 | Mauer | 123/479 |
| 5,222,394 | 6/1993 | Imai | 73/117.3 |
| 5,245,922 | 9/1993 | Denz | 123/501 |
| 5,309,757 | 5/1994 | Hashimoto et al. | 73/116 |
| 5,311,771 | 5/1994 | Young | 73/117.3 |
| 5,329,904 | 7/1994 | Kokubo et al. | 123/414 |
| 5,345,915 | 9/1994 | Scitmitz-Huebsch | 123/479 |
| 5,347,857 | 9/1994 | Mirhakimi et al. | 73/118.1 |
| 5,353,635 | 10/1994 | Saiki et al. | 73/117 |
| 5,460,134 | 10/1995 | Ott | 123/479 |
| 5,548,995 | 8/1996 | Clinton et al. | 73/116 |
| 5,584,274 | 12/1996 | Fukui et al. | 123/414 |

FOREIGN PATENT DOCUMENTS

| | | |
|---|---|---|
| 0602692 | 6/1994 | European Pat. Off. . |
| 0624723 | 11/1994 | European Pat. Off. . |
| 0683309 | 11/1995 | European Pat. Off. . |
| 9506812 | 3/1995 | WIPO . |

*Primary Examiner*—Carl S. Miller
*Attorney, Agent, or Firm*—David M. Masterson

[57] ABSTRACT

An apparatus for determining the timing of an internal combustion engine having a crankshaft, a camshaft, and a plurality of cylinders each having an electronically controlled fuel injector is disclosed. A crankshaft sensing device monitors the rotation of the engine crankshaft and responsively produces a crankshaft pulsetrain. Additionally, a camshaft sensing device monitors the rotation of the engine camshaft and responsively produces a camshaft pulsetrain. An engine control receives the crankshaft and camshaft pulsetrains, and responsively determines the period of each pulse, determines the rotational position of the crankshaft and camshaft, and produces an inject signal relative to one of the crankshaft and camshaft pulsetrains to the fuel injector in order to initiate fuel injection.

11 Claims, 3 Drawing Sheets

ENGINE TIMING APPARATUS AND METHOD OF OPERATING SAME

TECHNICAL FIELD

This invention relates generally to an apparatus and method for engine timing and, more particularly, to an apparatus and method that provides engine timing by sensing the rotation of one of the camshaft and crankshaft.

BACKGROUND ART

The timing of an internal combustion engine must be accurately controlled so that emissions are minimized and so that the engine runs at peak efficiency. In compression type diesel engines, ignition occurs upon injection of fuel into a cylinder containing air that has been compressed by a piston which is movable in the cylinder. The "timing" of such an engine is defined as the time at which a fuel injector is operated to inject fuel into the cylinder relative to the time at which the piston reaches a position known as "top dead center" in the cylinder that has reached the end of the piston stroke. Current state of the art engines typically include electronically controlled fuel injectors, which provides for efficient engine operation at maximum power.

In such engines that utilizes electronic fuel injectors, the position of the piston within the cylinders relative to top dead center must be measured. These measurements must be accurate in order to maximize engine operating efficiency. However, once the highly accurate measurement system fails, the entire engine control will shutdown. Consequently, it is desirable to introduce redundancy into the system in order to prevent catastrophic failure of the engine control system.

The present invention is directed toward overcoming one or more of the problems as set forth above.

DISCLOSURE OF THE INVENTION

In one aspect of the present invention, an apparatus for determining the timing of an internal combustion engine having a crankshaft, a camshaft, and a plurality of cylinders each having an electronically controlled fuel injector is disclosed. A crankshaft sensing device monitors the rotation of the engine crankshaft and responsively produces a crankshaft pulsetrain. Additionally, a camshaft sensing device monitors the rotation of the engine camshaft and responsively produces a camshaft pulsetrain. An engine control receives the crankshaft and camshaft pulsetrains, and responsively determines the period of each pulse, determines the rotational position of the crankshaft and camshaft, and produces an inject signal relative to one of the crankshaft and camshaft pulsetrains to the fuel injector in order to initiate fuel injection.

BRIEF DESCRIPTION OF THE DRAWINGS

For a better understanding of the present invention, reference may be made to the accompanying drawings in which.

BEST MODE FOR CARRYING OUT THE INVENTION

Figure 1:
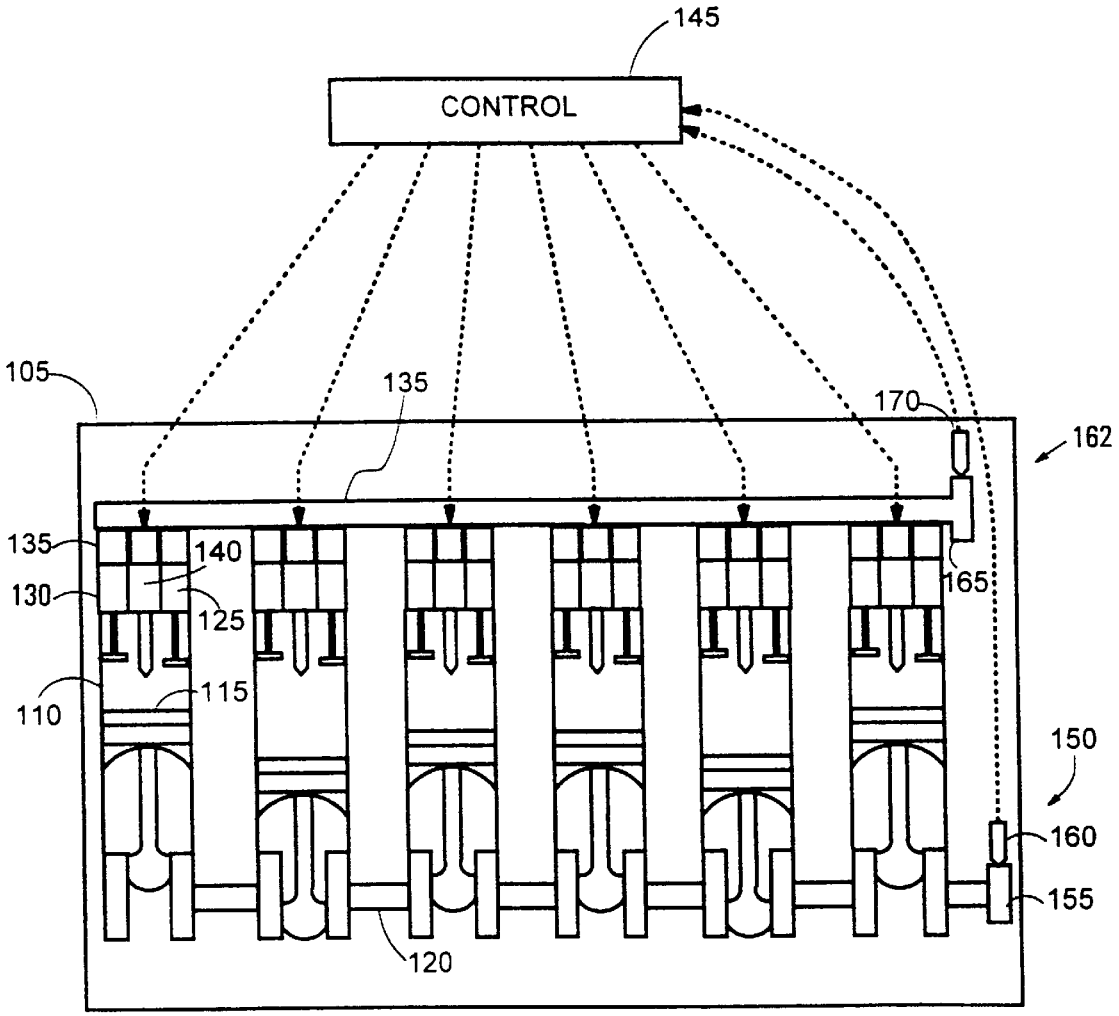
FIG. 1 is a block diagram representing an internal combustion engine in connection with an embodiment of the present invention.

Referring now to FIG. 1, an internal combustion engine 105 that includes a plurality of cylinders 110 is shown. Each cylinder includes a piston 115 connected to a crankshaft 120, an intake and exhaust valve 125,130 connected to a camshaft 135, and an electronic solenoid operated fuel injector 140. Each fuel injector includes a solenoid coil that is energized by a solenoid driver circuit, which is part of an engine control 145.

A crankshaft sensing means 150 monitors the rotation of the engine crankshaft 120 and responsively produces a crankshaft pulsetrain. The crankshaft sensing means 150 includes a crankshaft sensing wheel 155 having a plurality of spaced apart teeth connected to the crankshaft 120. In addition, the crankshaft sensing means includes a first magnetic pick-up device 160 located adjacent the crankshaft sensing wheel 155. The rotation of the crankshaft causes the teeth of the crankshaft sensing wheel to pass by the crankshaft magnetic pick-up device. The first magnetic pick-up device senses each passing tooth of the crankshaft sensing wheel and responsively produces the crankshaft pulsetrain. Each pulse of the crankshaft pulsetrain is indicative of a crankshaft sensing wheel tooth.

A camshaft sensing means 160, which is similar to the crankshaft sensing means 150, monitors the rotation of the engine camshaft 135 and responsively produces a camshaft pulsetrain. The camshaft sensing means 160 includes a camshaft sensing wheel 165 having a plurality of spaced apart teeth connected to the camshaft 135. In addition, the camshaft sensing means 160 includes a second magnetic pick-up device 170 located adjacent the camshaft sensing wheel 165. The rotation of the camshaft causes the teeth of the camshaft sensing wheel to pass by the second magnetic pick-up device. The second magnetic pick-up device senses each passing tooth of the camshaft sensing wheel and responsively produces the camshaft pulsetrain. Each pulse of the camshaft pulsetrain is indicative to a camshaft sensing wheel tooth.

In the preferred embodiment, both the crankshaft sensing wheel and the camshaft sensing wheel have 36 equally spaced teeth. The tooth to tooth spacing on the camshaft sensing wheel is 20 engine degrees, while the tooth to tooth spacing on the crankshaft sensing wheel is 10 engine degrees. Further, the camshaft sensing wheel additionally includes either one or three reference teeth placed about the 36 teeth in a predetermined pattern, while the crankshaft sensing wheel includes one or three additional slots that are placed at predetermined locations about the 36 teeth. A slot is defined as the spacing between two adjacent teeth. The predetermined pattern of each of the sensing wheels corresponds to the top-dead-center (TDC) position of cylinder #1. Consequently, the detection of the predetermined pattern indicates a complete rotation of the particular shaft, i.e., crankshaft or camshaft. Thus, each pulse of the respective pulsetrain is representative of the angular position of the particular shaft, and additionally is representative of the shaft speed and therefore engine speed.

Note, an additional tooth pattern is preferred for the camshaft sensing wheel because a predetermined amount of resolution is maintained. However, a missing tooth pattern is used on the crankshaft sensing wheel because an additional tooth pattern would not be detectable due to the high rotational speeds of the crankshaft at high engine speeds. (A single revolution of the camshaft sensing wheel represents 720 engine degrees, or a full engine cycle; while a single revolution of the crankshaft sensing wheel represents 360 degrees, or a half engine cycle.) However, the missing tooth pattern of the crankshaft sensing wheel does not sacrifice any significant resolution because the tooth to tooth spacing of the crankshaft provides for a great amount of resolution—even with the missing tooth pattern.

Figure 2:
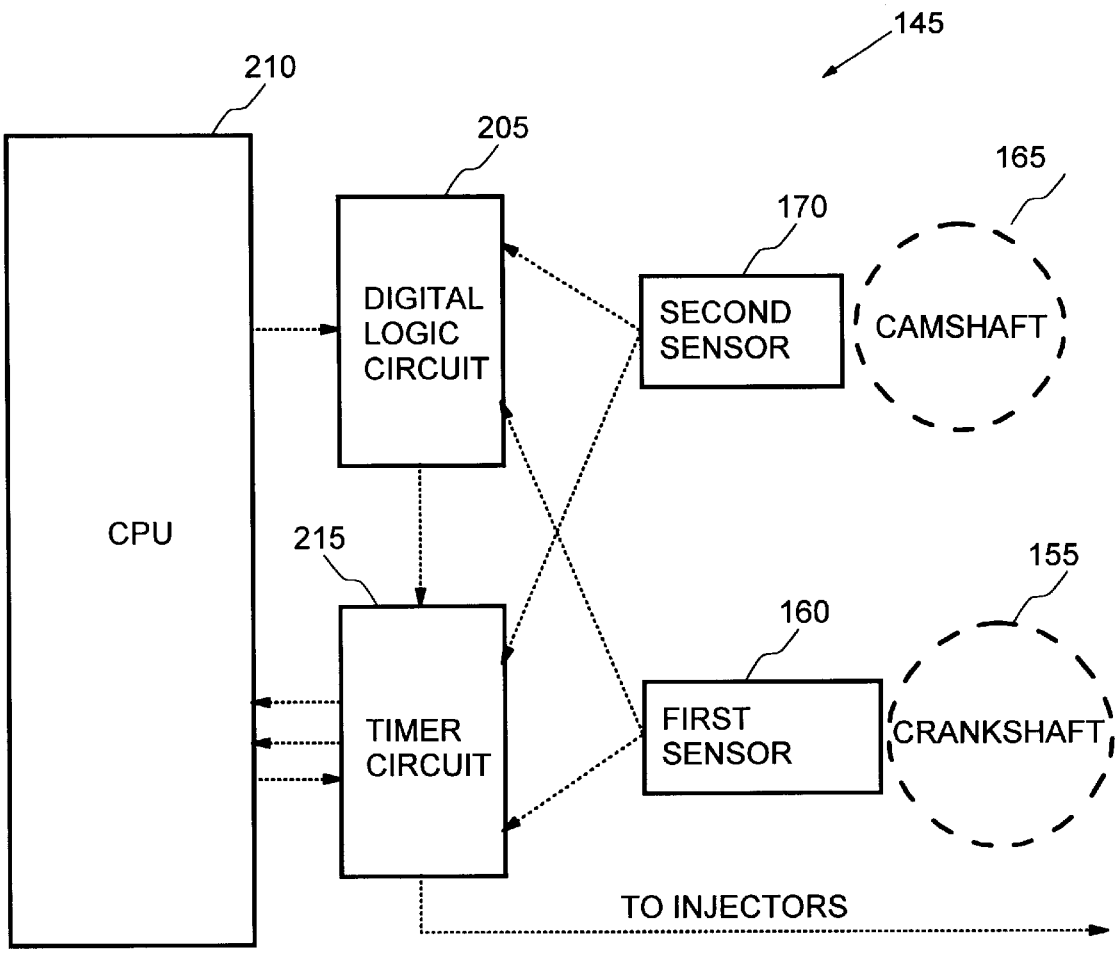
FIG. 2 is a block diagram of the electronic circuitry associated with the embodiment of the present invention.

Referring now to FIG. 2, a block diagram of the portion of the engine control 145 that is associated with present invention is shown. The specific circuit configuration to carry-out the invention is a matter of design choice and is not critical to the present invention.

A digital logic circuit 205 receives the crankshaft and camshaft pulsetrain. A microprocessor 210 determines which pulsetrain to use as a reference for fuel injection, and delivers a select signal to the digital logic circuit 205. In response to the select signal, the digital logic circuit 205 delivers a clock signal having a frequency equal to the selected pulsetrain to a programmable timer circuit 215. The programmable timer circuit 215 additionally receives the crankshaft and camshaft pulsetrains, and responsively determines the period of each pulse. A period is defined as the time interval between the rising edges of the consecutive pulses. More specifically, the programmable timer circuit 215 receives the crankshaft and camshaft pulsetrains, samples each pulse of each pulsetrain with a sampling rate provided by a clock signal, and delivers a measured period signal indicative of the period of each pulse to the microprocessor 210.

The microprocessor 210 monitors the rotational position of the crankshaft and camshaft by tracking the position of the respective sensing wheel. For example, the microprocessor 210 receives the measured period of each pulse of the crankshaft and camshaft pulsetrain from the programmable timer circuit 215 and counts the receipt of each pulse. In this manner, the microprocessor tracks the rotational position of each sensing wheel and the rotational position of the crankshaft and camshaft. Based on either the crankshaft or camshaft position, the microprocessor delivers an injection request signal to programmable timer circuit 215. Responsively, the programmable timer circuit delivers an inject signal to the appropriate injector in order to initiate fuel injection into the respective cylinder.

The present invention provides for at least two features. One is high resolution and the other is redundancy. For example, because the teeth to teeth spacing of the crankshaft sensing wheel 155 provides a great amount of resolution, the information provided by the crankshaft sensing means 150 is very accurate. Consequently, information provided by the crankshaft sensing wheel is used whenever possible. However, should the crankshaft sensing means fail or other problems occur that corrupts the information provided by the crankshaft sensing wheel, then the camshaft sensing means 160 may be adequately used to control fuel injection.

Figure 3:
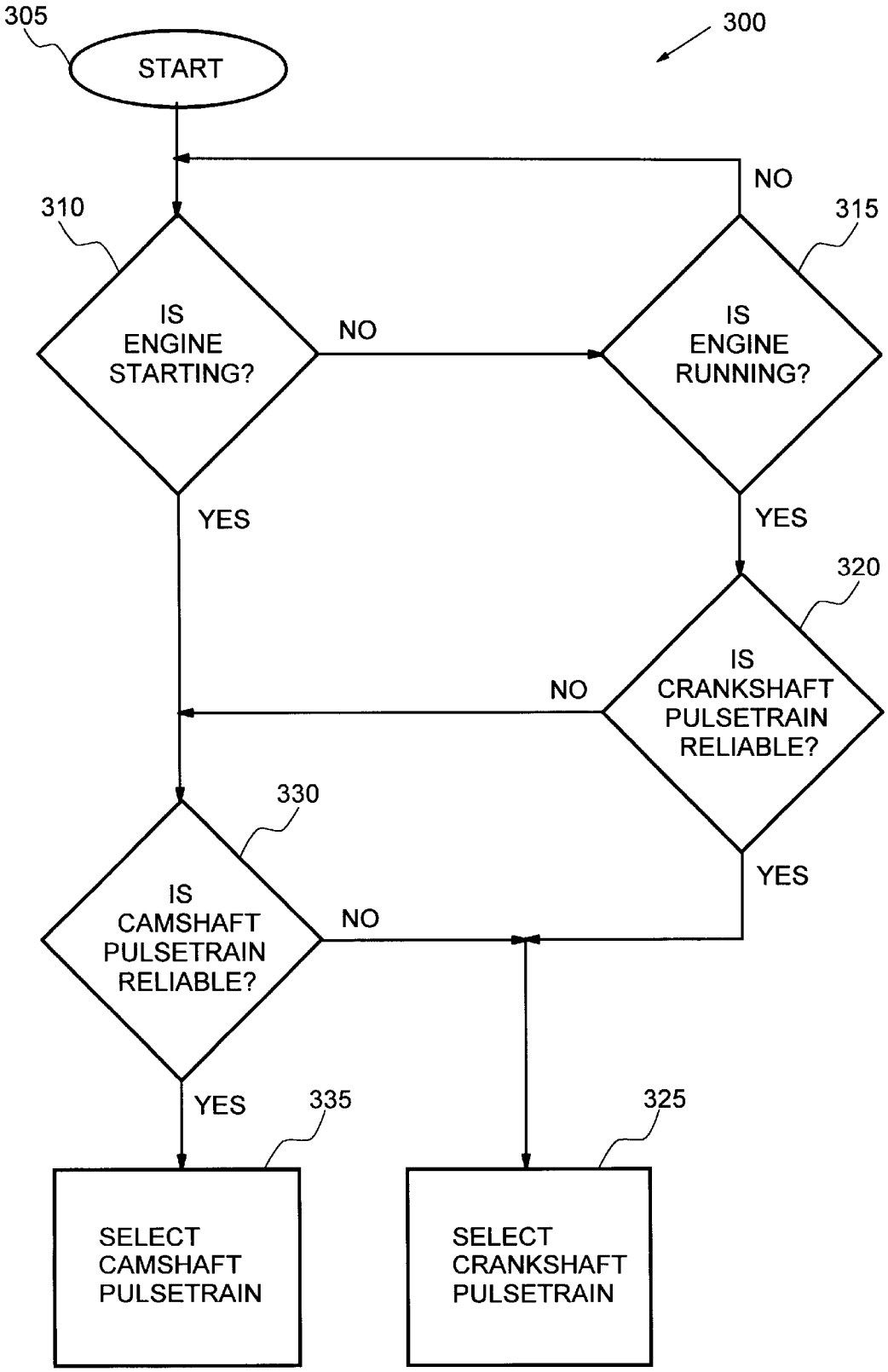
FIG. 3 is a flowchart representing the program control associated with the embodiment of the present invention.

Reference is now made to FIG. 3, which shows the program control associated with the microprocessor 210 that determines which pulsetrain to select in order to control fuel injection. Program control begins at block 305 and proceeds to block 310 where the control determines whether the engine is currently starting by determining the engine speed. If the engine is not currently starting, then the control transfers to block 315 where the control determines whether the engine is currently running by determining the engine speed. If the engine is currently running, then the control determines whether the crankshaft pulsetrain is reliable at block 320. The control can determine pulsetrain reliability in one of several methods including: determining whether the measured period signal of each pulse has a proper duration; counting the number of crankshaft pulses received by the programmable timer circuit 215 and determining if the number of crankshaft pulses corresponds to the number of teeth on the crankshaft sensing wheel; and counting the number of crankshaft pulses received by the programmable timer circuit 215, calculating the duration of each pulse and determining if the crankshaft pulses correctly corresponds to the predetermined locations of the additional slot(s). Note that, at least one crankshaft revolution must occur before the crankshaft pulsetrain is found reliable.

If the crankshaft pulsetrain is found to be reliable, then the control proceeds to block 325 where the crankshaft pulsetrain is selected for high accuracy. However, if the crankshaft pulsetrain is found to be unreliable, or if the engine is found to be starting, then the program control transfers to block 330 where the control determines whether the camshaft pulsetrain is reliable (by using similar methods to those described above). If the camshaft pulsetrain is found to be reliable, then the camshaft pulsetrain is selected. Note that, at least one camshaft revolution must occur before the camshaft pulsetrain is found reliable. However, if the camshaft pulsetrain is found to unreliable, then the crankshaft pulsetrain is selected at block 325.

Thus, when the engine is starting, the camshaft pulsetrain is selected as the reference for fuel injection. Once the engine is running, the crankshaft pulsetrain is selected, as it provides for a greater degree of resolution. The crankshaft pulsetrain will thereafter be used, unless the crankshaft pulsetrain is found to be unreliable. Then the camshaft pulsetrain will be used, as it provides for a satisfactory amount of resolution.

In a situation where the engine is currently starting, but the camshaft pulsetrain has shown to be unreliable, the program control must take corrective action due to the fact that the crankshaft pulsetrain will not immediately signify the beginning of the combustion stroke or the beginning of the intake stroke. In other words, because one revolution of the crankshaft pulsetrain is only representative of 360 engine degrees, or one half an engine cycle, the program control will not yet know which cylinder the crankshaft pulsetrain is referencing combustion at TDC. Consequently, when the engine is first being started, the program control will request half of the cylinders to operate or fire in a 2-cycle mode, rather than a 4-cycle mode, in order to determine which half of the engine cycle is being detected. Accordingly, the program control determines the engine speed using the crankshaft pulsetrain during each injection request, calculates the engine acceleration corresponding to each injection request, and determines which half of the engine cycle is being detected. For example, if the control has determined that an injection request has caused the engine to decelerate, then the corresponding injection request has not caused combustion in that cylinder. Alternatively, if the control has determined that an injection request has caused the engine to accelerate, then the corresponding injection request has caused combustion in that cylinder. Once the program control determines that three successive cylinders are firing, or alternatively, that three successive cylinders are not firing (for a six cylinder engine), then the program control "knows" which half of the engine cycle has occurred or is being detected. Thereafter, the engine cylinders can be operated properly in 4-cycle mode because the program control has determined which cylinder the crankshaft pulsetrain is representing combustion at TDC.

Thus, while the present invention has been particularly shown and described with reference to the preferred embodiment above, it will be understood by those skilled in the art that various additional embodiments may be contemplated without departing from the spirit and scope of the present invention.

INDUSTRIAL APPLICABILITY

With the advent of electronically controlled engines, it becomes increasingly important to provide timing information with high accuracy. Advantageously, the present invention precisely monitors the rotation of the crankshaft and provides accurate timing information. However, if a failure occurs with the crankshaft sensing means, then the present invention provides for the engine to remain in operation by providing timing information relative to the rotation of the camshaft.

Other aspects, objects and advantages of the present invention can be obtained from a study of the drawings, the disclosure and the appended claims.

We claim:

1. An apparatus for determining the timing of an internal combustion engine having a crankshaft, a camshaft, and a plurality of cylinders each having an electronically controlled fuel injector, comprising:

a crankshaft sensing means for monitoring the rotation of the engine crankshaft and responsively producing a crankshaft pulsetrain; and an engine control means for receiving the crankshaft pulsetrain and responsively determining the period of each pulse, determining the rotational position of the crankshaft by determining which half of the engine cycle is represented by the crankshaft pulsetrain, and producing an inject signal relative to the crankshaft pulsetrain to the fuel injector in order to initiate fuel injection.

2. An apparatus, as set forth in claim 1, wherein the crankshaft sensing means includes:

a crankshaft sensing wheel having a plurality of spaced apart teeth connected to the crankshaft; and a first magnetic pick-up device located adjacent the crankshaft sensing wheel, the first magnetic pick-up device sensing each passing tooth of the crankshaft sensing wheel and responsively producing the crankshaft pulsetrain, wherein each pulse of the crankshaft pulsetrain is indicative of a crankshaft sensing wheel tooth.

3. An apparatus, as set forth in claim 2, including a camshaft sensing means for monitoring the rotation of the engine camshaft and responsively producing a camshaft pulsetrain.

4. An apparatus, as set forth in claim 3, where the camshaft sensing means includes:

a camshaft sensing wheel having a plurality of spaced apart teeth connected to the camshaft; and a second magnetic pick-up device located adjacent the camshaft sensing wheel, the second magnetic pick-up device sensing each passing tooth of the camshaft sensing wheel and responsively producing the camshaft pulsetrain, wherein each pulse of the camshaft pulsetrain is indicative to a camshaft sensing wheel tooth.

5. A method for determining the timing of an internal combustion engine having a crankshaft, a camshaft, and a plurality of cylinders each having an electronically controlled fuel injector, comprising the steps of:

monitoring the rotation of the engine crankshaft and responsively producing a crankshaft pulsetrain;

monitoring the rotation of the engine camshaft and responsively producing a camshaft pulsetrain; and receiving the crankshaft and camshaft pulsetrains, responsively determining the period of each pulse, determining the rotational position of the crankshaft and camshaft, determining whether the camshaft pulsetrain is indicative of reliable information and determining which half of the engine cycle is represented by the crankshaft pulsetrain and producing an inject signal relative to the crankshaft pulsetrain to the fuel injector in order to initiate fuel injection in response to the camshaft pulsetrain being unreliable.

6. A method, as set forth in claim 5, including the steps of:

determining the engine speed in response to one of the crankshaft and camshaft pulsetrains;

selecting the camshaft pulsetrain as a reference to determine the when to initiate fuel injection; and thereafter, selecting the crankshaft pulsetrain as a reference to determine when to initiate fuel injection.

7. A method, as set forth in claim 6, wherein the step of selecting the crankshaft pulsetrain includes the steps of determining whether the crankshaft pulsetrain is indicative of reliable information, and selecting the camshaft pulsetrain in response to the crankshaft pulsetrain being unreliable.

8. A method, as set forth in claim 7, wherein the step of determining which half of the engine cycle is represented by the crankshaft pulsetrain, includes the following steps:

requesting half of the cylinders to operate in a 2-cycle mode;

determining the engine speed using the crankshaft pulsetrain during each injection request, calculating the engine acceleration corresponding to each injection request, and determining which half of the engine cylinders operation that the crankshaft pulsetrain is representing; and thereafter, requesting all of the engine cylinders to operate in 4-cycle mode.

9. An apparatus, as set forth in claim 4, including:

a digital logic circuit for receiving the crankshaft and camshaft pulsetrain;

a microprocessor for determining which one of the crankshaft and camshaft pulsetrains to use as a reference for fuel injection, and delivering a select signal to the digital logic circuit, wherein the digital logic circuit produces a clock signal having a frequency equal to the selected pulsetrain; and a programmable timer circuit for receiving the crankshaft and camshaft pulsetrains and the clock signal, sampling each pulse of each pulsetrain with a sampling rate provided by the clock signal, and producing a measured period signal indicative of the period of each pulse.

10. An apparatus, as set forth in claim 9, wherein the microprocessor receives the measured period of each pulse of the crankshaft and camshaft pulsetrain from the programmable timer circuit and counts the receipt of each pulse, determines the rotational position of the crankshaft and camshaft sensing wheels, and delivers an injection request signal to the programmable timer circuit, wherein the programmable timer circuit delivers an inject signal to the appropriate injector in order to initiate fuel injection into the respective cylinder.

11. An apparatus, as set forth in claim 10, wherein the each of the crankshaft sensing wheel and the camshaft sensing wheel have 36 equally spaced teeth, the tooth to tooth spacing on the camshaft sensing wheel being 20 engine degrees and the tooth to tooth spacing on the crankshaft sensing wheel being 10 engine degrees, wherein the camshaft sensing wheel additionally includes three reference teeth placed about the 36 teeth in a predetermined pattern, and the crankshaft sensing wheel includes three additional slots placed at predetermined locations about the 36 teeth.

* * * * *